United States Patent [19]

Huegy

[11] Patent Number: 4,531,333

[45] Date of Patent: Jul. 30, 1985

[54] HELICAL DOME

[76] Inventor: Charles W. Huegy, 2 Mann St., Irvine, Calif. 92715

[21] Appl. No.: 433,454

[22] Filed: Dec. 20, 1982

[51] Int. Cl.[3] ..... E04B 1/32

[52] U.S. Cl. ..... 52/81; 52/DIG. 10

[58] Field of Search ..... 52/81, DIG. 10, 749

[56] References Cited

U.S. PATENT DOCUMENTS 3,062,334 11/1962 Henning ..... 52/81
3,292,316 12/1966 Zeinetz ..... 52/81
3,955,329 5/1976 Hannula ..... 52/81
4,092,810 6/1978 Sumner ..... 52/81
4,187,613 2/1980 Ivers et al. ..... 52/81 X

OTHER PUBLICATIONS

*Geodesics,* Edward Popko, 1968, Figs. 47–48.
*Raumliche Tragwerke aus Stahl,* Z. S. Makowski, 1963, p. 142.

*Primary Examiner*—Carl D. Friedman

[57] ABSTRACT

A dome structure wherein all of the junctures of surface struts or plates follow a design based on a modified helix formula.

2 Claims, 21 Drawing Figures

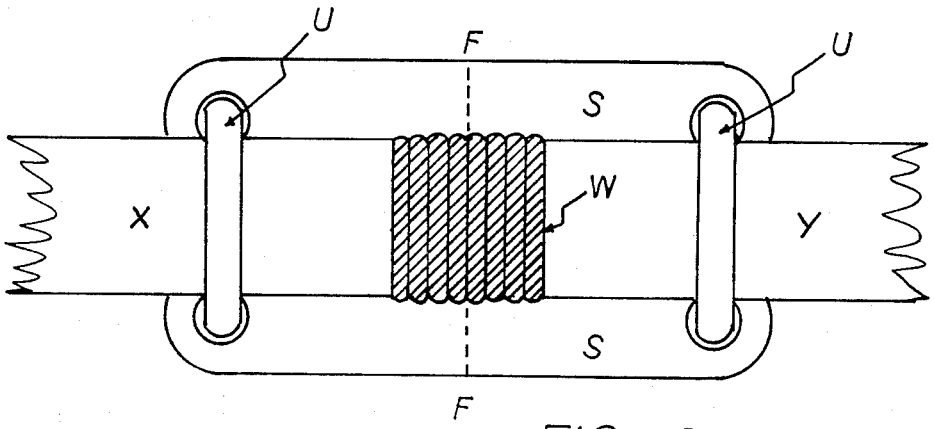
FIG. 16.
FIG. 17.
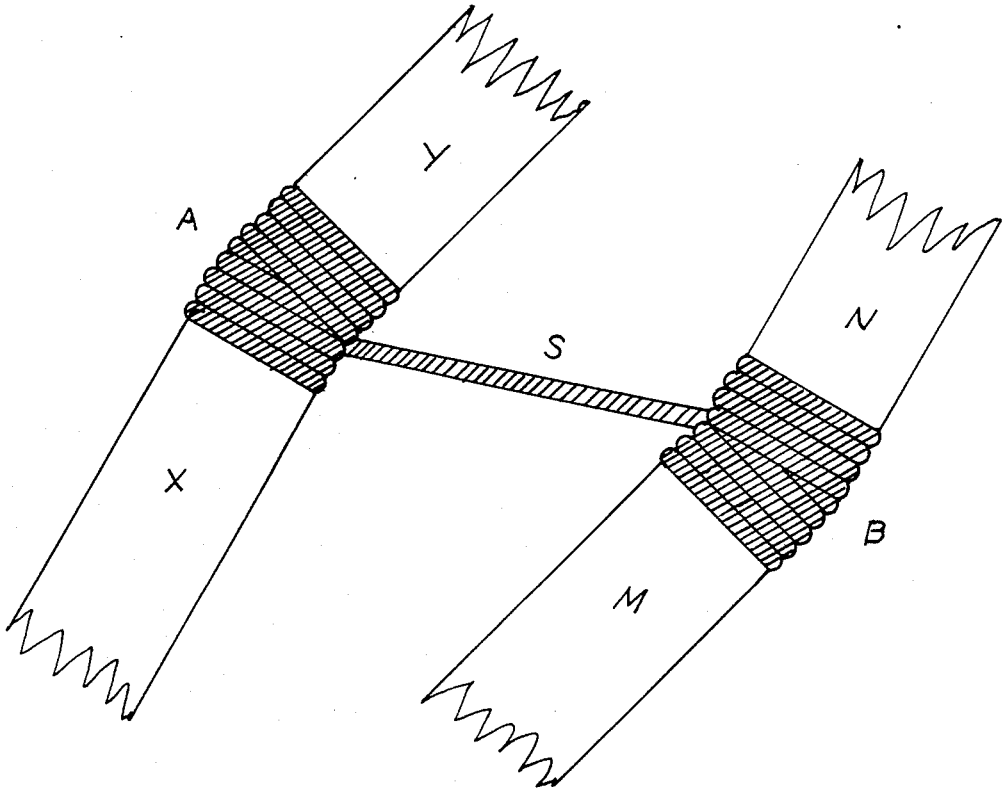

HELICAL DOME

CROSS REFERENCES

Construction of Domes utilizing triangular arrangements of struts or plates is an old technique known generally as geodesic. The prior art provides many examples of joining such struts or plates.

SUMMARY

The building is designed according to a precise mathematical formula from which all points of juncture for struts or plates may be readily determined. The formula is a variant of the helix formula and when it is applied in both a clockwise and counter clockwise manner to the surface of a sphere, ellipse, or such like shape defines a polygonal grid on the surface.

The helix formula used is a modified version of its usual form: $Z=b'\theta$, where Z is a dependent variable perpendicular height from the base of the dome to a point on its surface; where b' is a parameter which can take on any list of values and not a constant; where $\theta$ is an independent variable of the angle between the abscissa and a vector from the center of the dome to the base of a perpendicular for height. The length of the vector from the center may be found from the theorem of Pythagoras: $a'=\sqrt{r^2-Z^2}$, where a' is a dependent variable length of the vector from the center of the dome to the base of a perpendicular for height; where r is the radius of the dome; where Z is the height of a perpendicular from the base to a point on the dome's surface, and where as successive values are taken on by the independennt variable $\theta$ the corresponding values for Z and a' are determined for each joint. Flexibility of result approaching infinity comes from the infinite list of values that can be selected for the parameter b'. For example, values for b' can be selected to relieve a tendency for struts to pack too closely together at the top, or opposite at the bottom where they might be too far apart. Manipulation of the values for b' gives complete freedom of the resultant juncture points. For example, only the last value for b' could be smaller or zero to make the last joint diappear or appear lower down the surface, and so forth.

A single pair of apices opposite one another may be chosen from each polygon. These apices may be connected in some way to form a pair of symmetrical triangles. This connection of apices may be either "horizontal", that is parallel to the ground, or "vertical", that is not parallel to the ground, but, rather, in a plane at right angles to connections made "horizontally". If desired, connections could be made in both the "horizontal" and "vertical" directions. In any of these cases a pattern of triangles will emerge which has come to be known as geodesic. By interrupting this pattern at specific points and making calculated adjustments, conventional shaped and sized apertures can be provided for doors or windows, or for panels allowing one or more structures to be easily conjoined.

The use of the helix formula also enables the use of a simple building system that facilitates precise construction.

DESCRIPTION OF THE DRAWINGS

FIG. 16 is a planer drawing of a mitered and wrapped joint for structural members of curvilinear sided material called "poles".

FIG. 17 is a top view drawing of two mitered and wrapped joints for curvilinear or flat sided structural members called "poles" or "beams" connected by a flexible material called "guy strut".

DESCRIPTION

Figure 1:
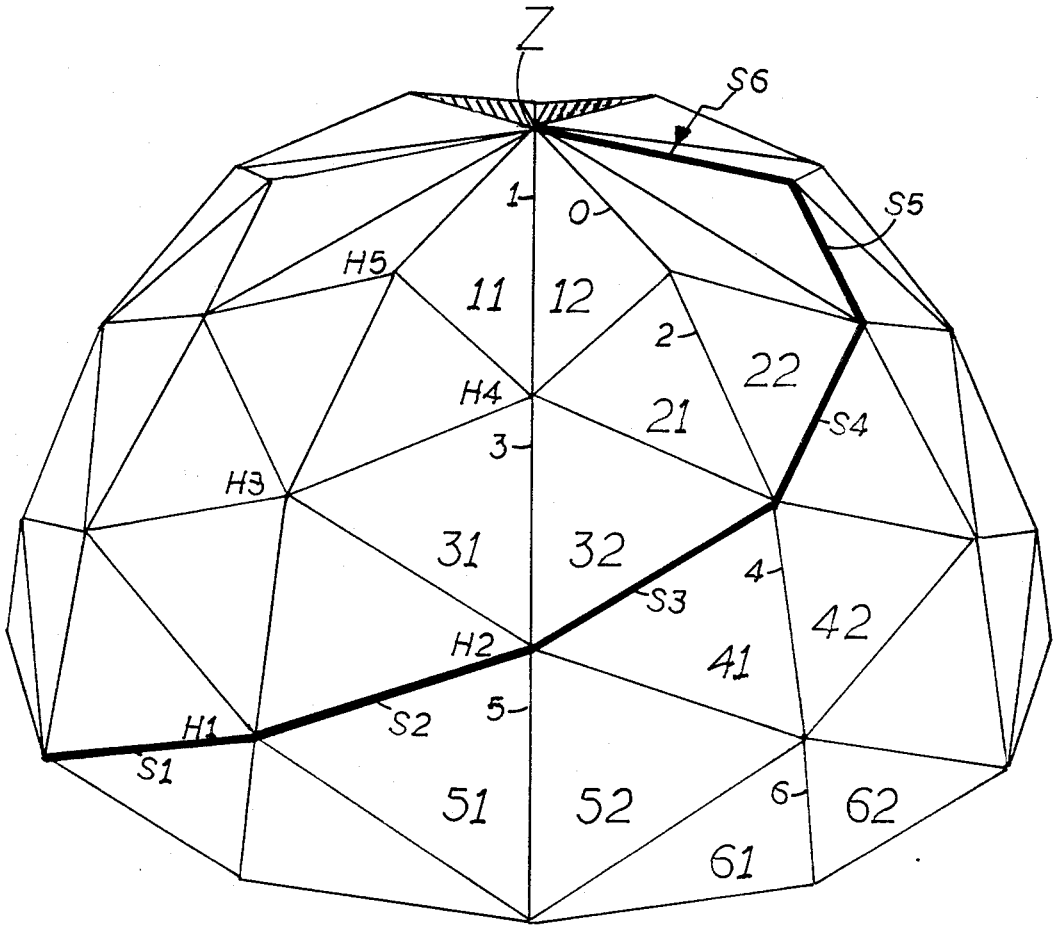
FIG. 1 is a persepctive drawing of a single structure embodying the helix formula.
Figures 2, 3:
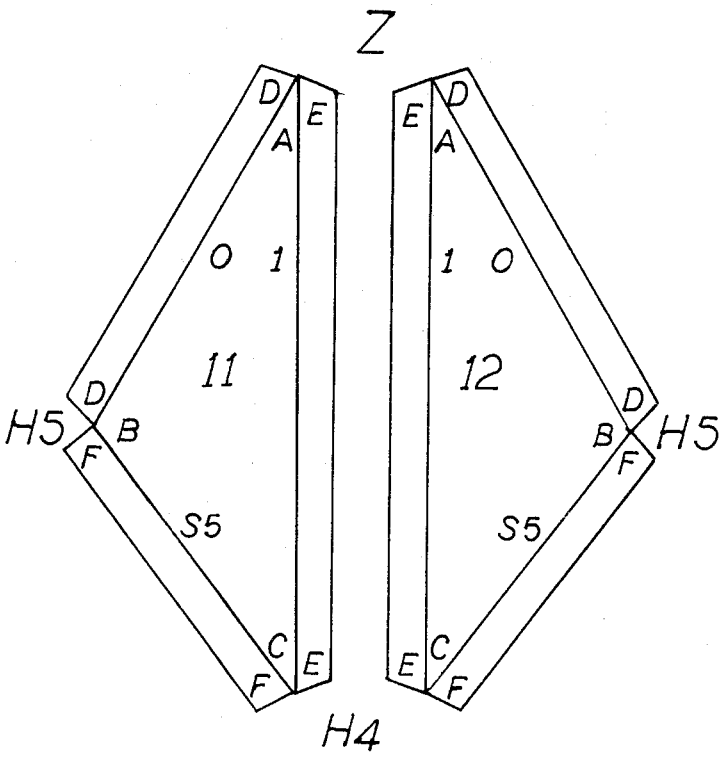
FIG. 2 through FIG. 13 are planer layouts of the left and right portions of the divided polygons.
Figures 4, 5:
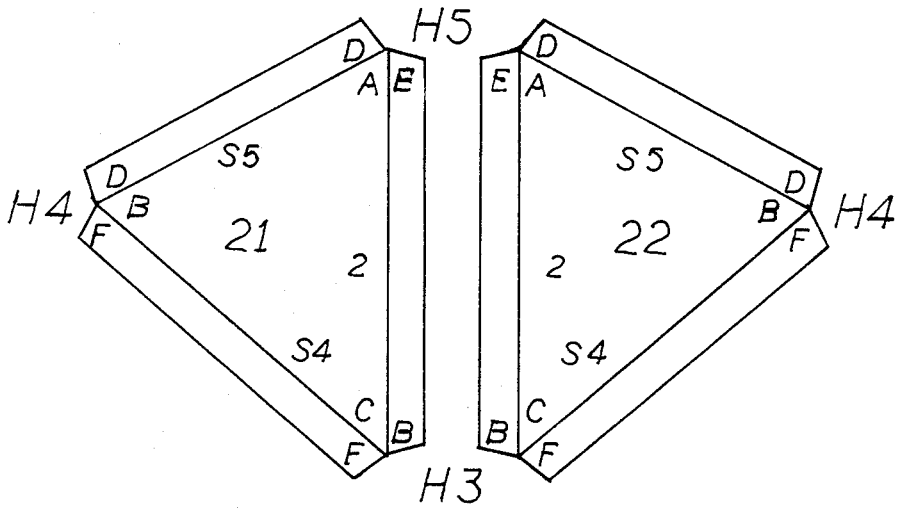
Figures 6, 7:
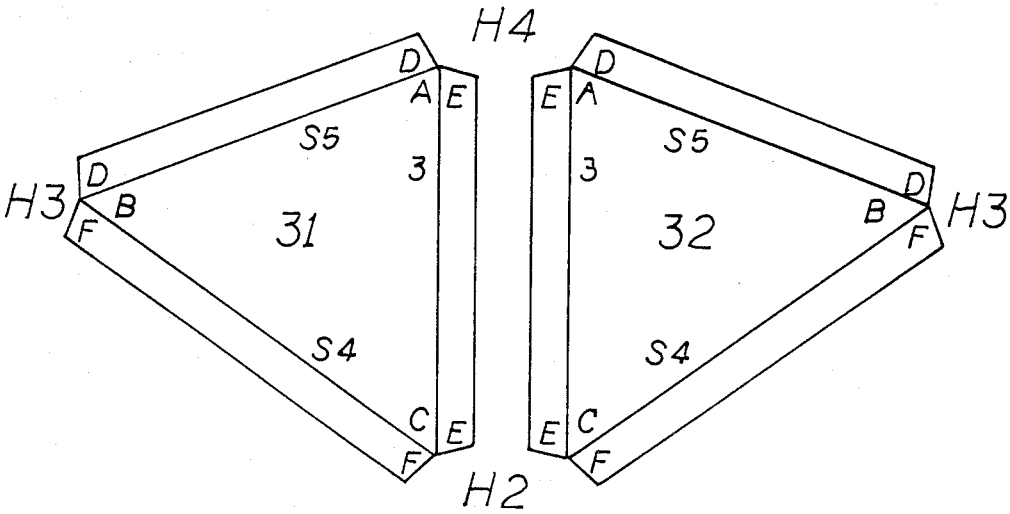
Figures 8, 9:
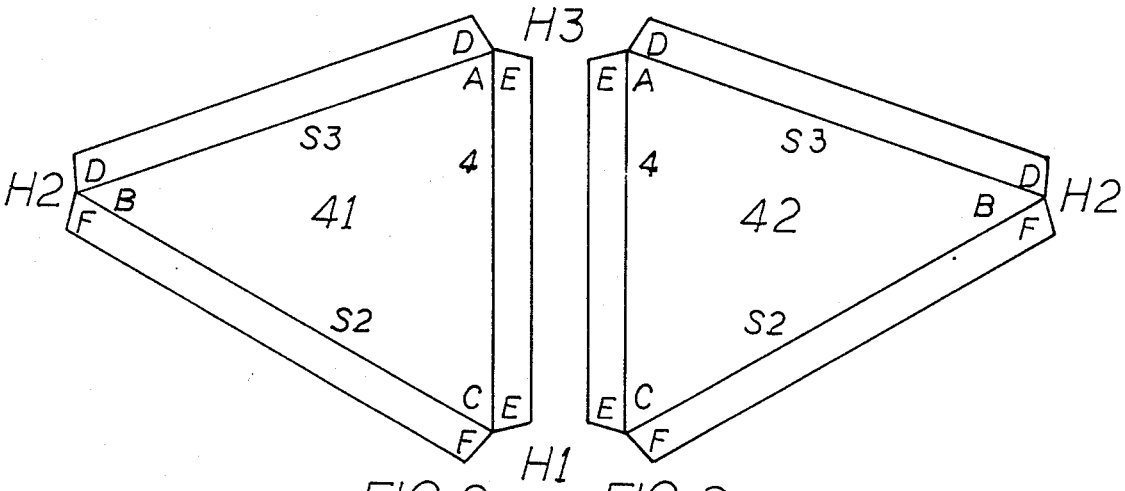
Figure 10:
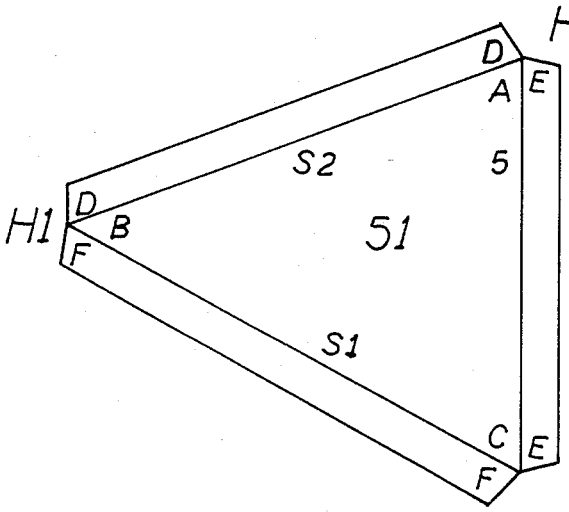
Figure 11:
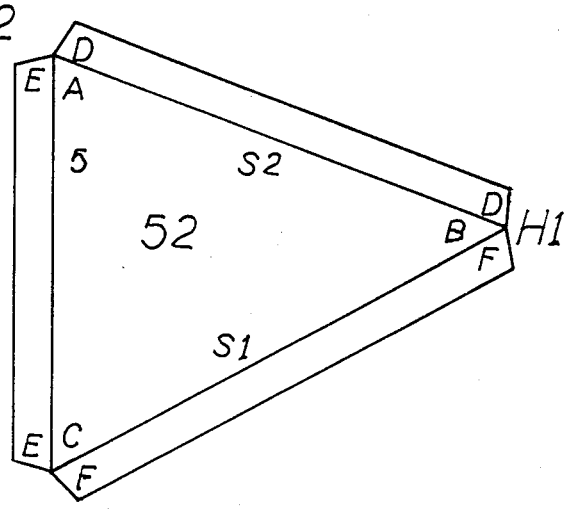
Figure 12:
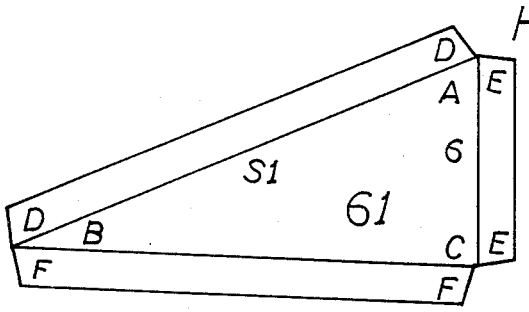
Figure 13:
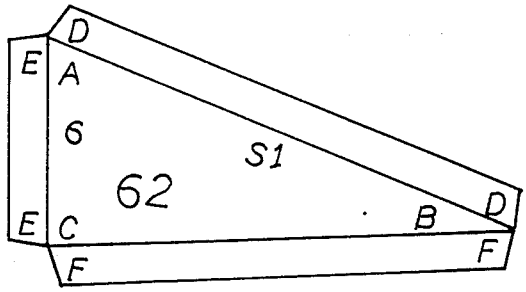

A roughly spherical shape of the dome is shown in FIG. 1. One set of six struts or plate edges following the complete helical path from base to zenith is shown in bold lines. The segments of the path are designated S1, S2, S3, S4, S5, and S6. Around the bold lines of the helical path there are a series of twelve triangles formed by connecting the apices of six polygons. The dome is made up of thirty six such bisected polygons where the bisection is performed "vertically". Bisection of the polygons creates twice the number of triangles, or seventy two for the whole dome. Point Z at the top of the structure is the focal point of the dome since all the helical paths from the base to zenith terminate at that point. The seven "vertical" struts or plate edges are numbered 0, 1, 2, 3, 4, 5, and 6 starting at the zenith and proceding to the base. One strut or plate edge at the top is given two designations: S6 when considered as a strut following the helical path and 0 when considered as a "vertical" strut or plate edge. The twelve triangular plates are numbered: 11, 12, 21, 22, 31, 32, 41, 42, 51, 52, 61, and 62, with the numbers being in serial order from zenith to base according to the tier of the divided polygon. The leftward triangle of the pair of symetrical triangles receives the lower number for the pair. Finally, the points of connection for struts are designated H1, H2, H3, H4, H5, and Z from the base polygon to the zenith. All the polygons of the dome are dished outward except the top ones numbered 11 and 12 which are dished inward giving the top a slightly fluted appearance. Two of the top triangles at the back are shaded to show a representative pair of dished in triangles at the top. FIG. 2 through FIG. 13 show in planar form a complete set of the structural triangle types. Five other sets exactly like this complete a whole dome. Letters A, B, and C are used to designate the angles of the triangles. Letters D, E, and F are used to designate the angles of construction flanges which would be folded under at the fold lines on the edges of the triangles to form a kind of triangular box.

Figure 14:
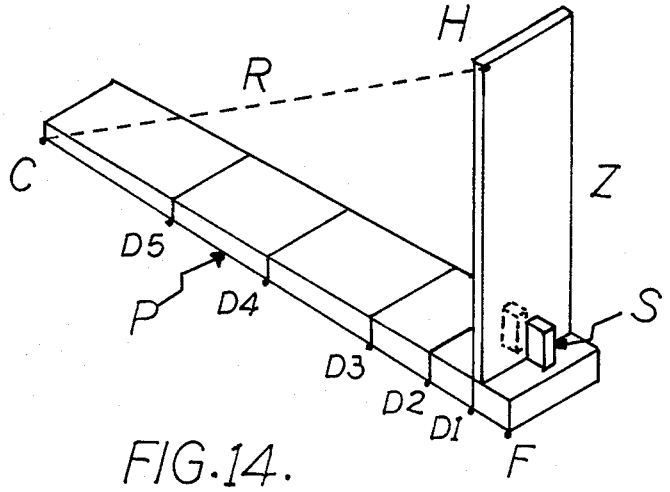
FIG. 14 is aperspective drawing of the construction jig.

FIG. 14 shows the construction jig in perspective. In this drawing the perpendicular heights from the base of the jig are derived from the modified helix formula:

$Z=b'\theta$, where Z is the dependent variable perpendicular height from the base of the jig to a point on the dome's surface; where b' is a parameter which can take on any list of values and not a constant; where $\theta$ is an independent variable angle between the abscissa and the base of the jig. Horizontal distances on the base of the jig are derived from the theorem of Pythagoras: $a'=\sqrt{r^2-Z^2}$, where a' is a dependent variable for the vector distance from the center of the dome to the base of a perpendicular to the surface of the dome; where r is the radius of the dome; where Z is a perpendicular height from the base of the jig to a point on the surface of the dome, and where as successive values are taken on by the independent variable $\theta$ the corresponding values for Z and a' are determined for each joint. Each point H on the dome representing an apice of several polygons is a precise distance R from the point C at the center of the dome. This distance R is indicated by the dotted line in FIG. 14. At the base of the jig a precise distance P will be defined from the center of the dome to its perimeter, and this distance P will also be the same as the radius of the dome. Points D1, D2, D3, D4, and D5 on the base member correspond to points directly above on the surface of the dome designated H1, H2, H3, H4, and H5 where apices of the triangles intersect. For example, on the jig shown in FIG. 14 point D1 corresponds to point H1 on the dome shown in FIG. 1. These points designated D are the locus of a line across the jig. Member Z is an upright corresponding to the height of the construction points designated H on the dome directly above points designated D on the jig. Each Z member will have a flat surface at its base which is brought into contact with the line at points designated D. To achieve each new height a new Z piece taller than the last will be brought into contact with a new line at points D.

A right angle support member designated S will flank each side of the Z piece to ensure that it remains upright at 90°. Construction will proceed by making suitable connections at point H on upright Z.

Figure 15:
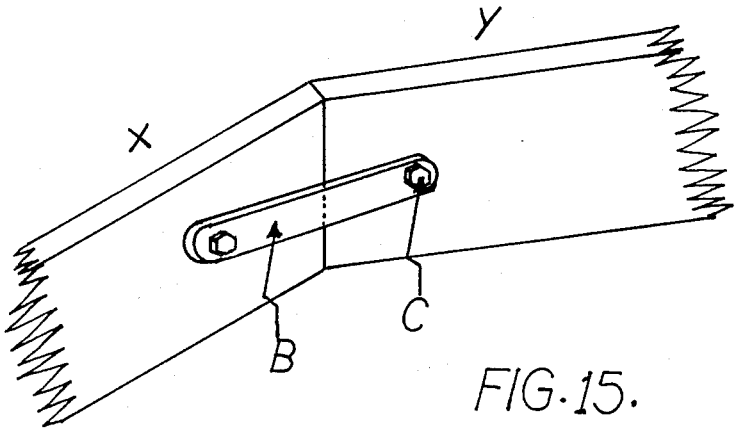
FIG. 15 is a perspecive drawing of a mitered joint formed from structural members of flat sided material called "beams".

FIG. 15 is a perspective drawing of a joint made at a connection point H of "beams" precisely mitered and glued together to match the bisected angle of a "beam" following the path of "vertical" or helical members from the base to the zenith. Metal straps designated B are bolted together on both sides of the "beam" pieces designated X and Y by bolts designated C.

FIG. 16 shows in planar form a top view of a joint made at a connection point H from "poles" mitered to match the bisected angle of a "beam" or "pole" following the path of "vertical" or helical members from the base to the zenith. This joint is glued and wrapped by material designated W to join two "poles" designated X and Y. U bolts are designated U; the straps are designated S; the fold line for the straps is designated F and shown dashed.

FIG. 17 shows two wrapped joints designated A and B for two "beams" or "poles" designated X, Y, M, and N guyed by a strut of flexible material lashed to each joint and following the helical path or "vertical" path and designated S.

Figure 18:
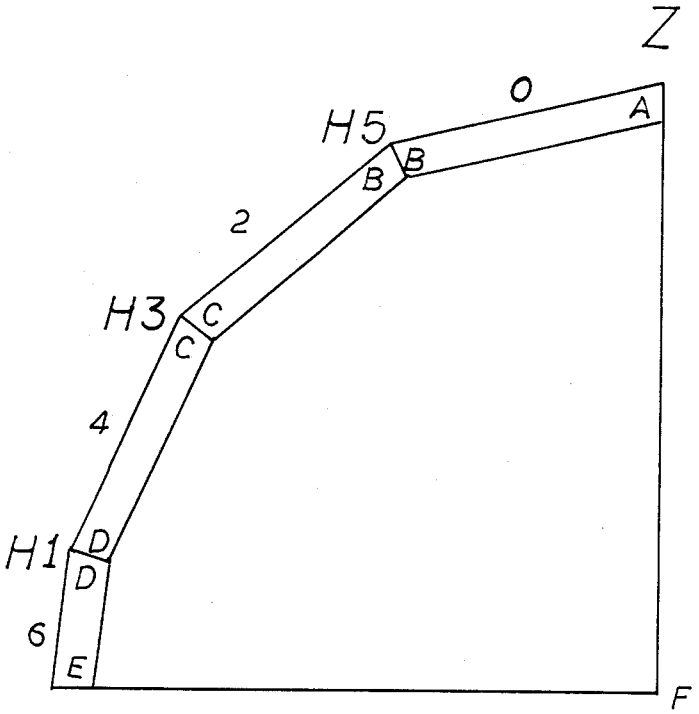
FIG. 18 is a planer layout of one "vertical" structural member type.

FIG. 18 shows a "beam" or "pole" in planer layout following the path of four "verticals" from base to zenith. The members are designated 0, 2, 4, and 6 as in FIG. 1. Each connection point H1, H3, H5, and Z are also the same as those in FIG. 1. Angles B, C, and D are those to be bisected and joined as shown in FIG. 15 and FIG. 16. Angle A forms a juncture with the top hub or "pole" and angle E forms a juncture with the floor. Point F is the center of the floor. In a dome with twelve "vertical" "beams" or "poles" six would have four parts as the one shown in FIG. 18.

Figure 19:
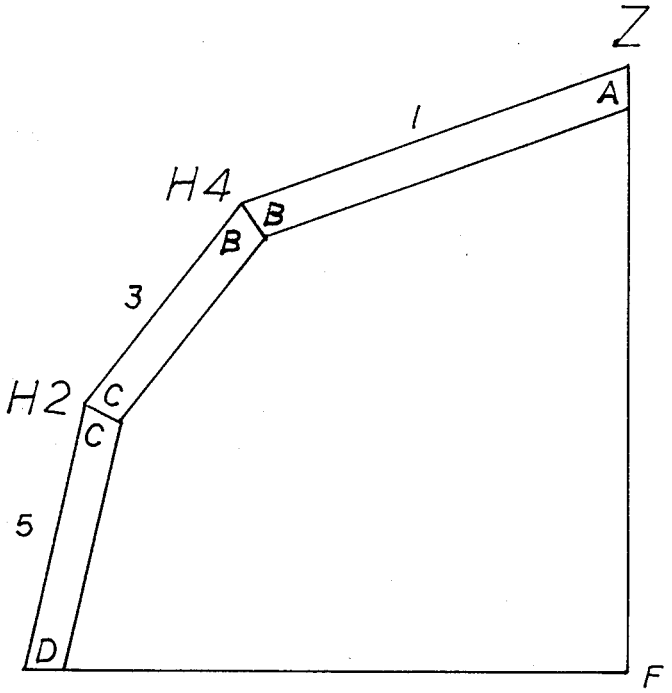
FIG. 19 is a planer layout of another "vertical" structural member type.

FIG. 19 shows a second "vertical" "beam" or "pole" with three members designated 1, 3, and 5 as in FIG. 1. Letters B, and C designate the angles to be mitered at the connection points designated H2, and H4 by a bisection of the angles B and C. The dome is joined to the floor by angle D and the center hub or "pole" by angle A. Point F is the center of the floor. In a dome with 12 "vertical" "beams" or "poles" six would have parts as shown in FIG. 19.

Figure 20:
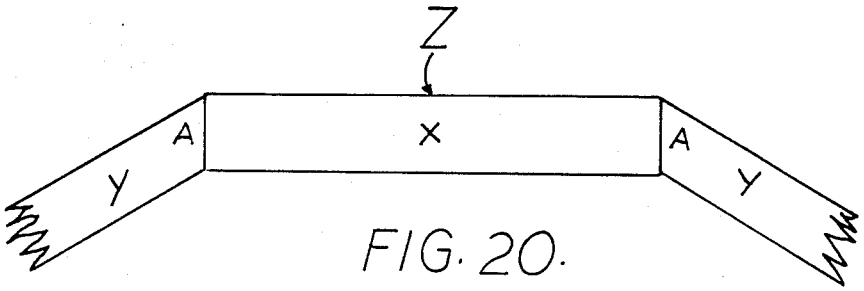
FIG. 20 is a side view of the juncture of two flat sided or curvilinear sided structural members called "beams" or "poles" at the zenith hub.

FIG. 20 shows in a side view two "beams" or "poles" connected to a center "pole" or hub. The center of such a "pole" or hub would be at point Z, as shown previously in FIG. 1. Angle A is the angle of juncture of the "beams" or "poles" to the hub or "pole". Part X is the hub and parts lettered Y are the "beams" or "poles".

Figure 21:
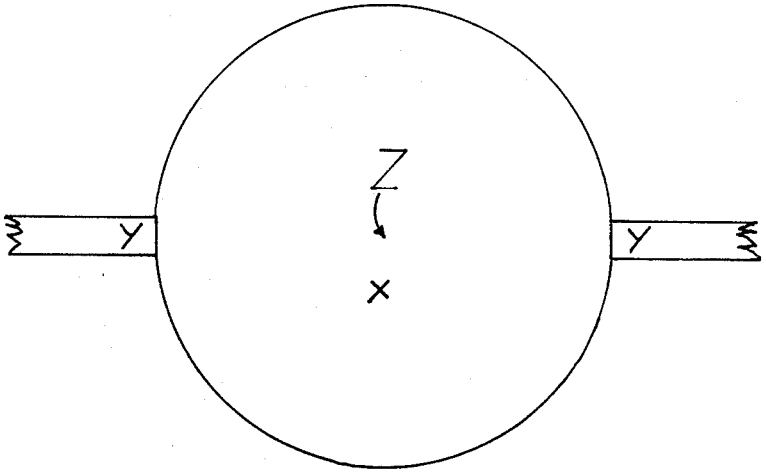
FIG. 21 is a top view of the juncture of two flat sided or curvilinear sided structural members called "beams" or "poles" at the zenith hub.

FIG. 21 shows a top view of the same two "beams" or "poles" connected to a center hub. Once again, as in FIG. 20 the "beams" or "poles" are numbered Y and the hub is lettered X. The zenith is designated Z.

I claim:

1. A geodesic dome structure comprising:

a. a joint pattern based on a variant of the helix formula: $Z=b'\theta$, where Z is a dependent variable perpendicular height from the base of the dome to a point on the dome's surface directly above, where b' is a parameter which can take on any list of values and not a constant; where $\theta$ is an independent variable for the angle between the abscissa and a vector from the center of the dome to the base of a perpendicular and the use of the theorem of Pythagoras: $a'=\sqrt{r^2-Z^2}$' where a' is a dependent variable for the vector from the center of the dome to the base of a perpendicular; where r is the radius of the dome; where Z is the height of a perpendicular from the base to a point on the dome's surface, and where as successive values are taken on by the independent variable $\theta$ the corresponding values for Z and a' are determined for each joint, and where smaller values may be selected for b' in order to pull joints back from the zenith to relieve a tendency they have of crowding together at the top, b. a set of structural members spiraling from joint to joint along a helical path from base to zenith, c. a set of structural members proceeding from joint to joint from base to zenith along a path on a plane perpendicular to the base, d. a set of structural members proceeding from joint to joint along paths parallel to the base.

2. The structure of claim 1, wherein a jig is used for precise location of junctures, precise mitering, and holding work in assembly of structural members and the jig derived from the modified helix formula: $Z=b'\theta$, where Z is the dependent variable height to the surface of the dome perpendicular to the base of the jig; where b' is a parameter which may take on any list of values and not a constant; where $\theta$ is an independent variable angle between the abscissa and the base of the jig, and where horizontal distances on the base of the jig are derived from the theorem of Pythagoras: $a'=\sqrt{r^2-Z^2}$, where a' is a dependent variable for the vector from the center of the dome; where Z is a perpendicular height from the base of the jig to a point on the surface of the dome, and where as successive values are taken on by the independent variable $\theta$ the corresponding values for Z and a' are determined for each joint.

* * * * *